United States Patent [19]

Johnsen

[11] 4,015,317

[45] Apr. 5, 1977

[54] PROCESS FOR SIZING TEXTILE FIBERS FOR USE ON WATER JET LOOMS

[75] Inventor: Kenneth E. Johnsen, Midland, Mich.

[73] Assignee: The Dow Chemical Company, Midland, Mich.

[22] Filed: Feb. 18, 1976

[21] Appl. No.: 658,972

[52] U.S. Cl. ..... 28/72.6; 8/138; 139/435; 260/29.6 H

[51] Int. Cl.[2] ..... D06C 29/00; D06L 1/14; C08F 220/04; D03D 47/32

[58] Field of Search ..... 28/72.6, 28; 260/29.6 H, 29.6 AT, 88.1 PC, 29.7 H; 139/435; 8/138

[56] References Cited

UNITED STATES PATENTS

| | | | |
|---|---|---|---|
| 3,476,155 | 11/1969 | Carothers | 139/435 |
| 3,671,295 | 6/1972 | Rauue et al. | 260/29.6 H |
| 3,677,989 | 7/1972 | Jenkinson | 260/29.6 H |
| 3,741,925 | 6/1973 | McDonald | 260/29.6 H |
| 3,756,973 | 9/1973 | Stahl | 260/29.6 H |
| 3,799,901 | 3/1974 | McCann et al. | 260/29.6 H |
| 3,814,141 | 6/1974 | Iribe et al. | 139/435 |
| 3,899,810 | 8/1975 | Stanley et al. | 28/72.6 |
| 3,909,477 | 9/1975 | Madison et al. | 260/29.7 H |

*Primary Examiner*—Louis K. Rimrodt
*Attorney, Agent, or Firm*—M. S. Jenkins

[57] ABSTRACT

Textile fibers exhibiting improved characteristics for weaving on water jet looms are prepared by sizing such fibers with copolymers of an aliphatic $\alpha$-olefin such as ethylene and an ammoniated $\alpha,\beta$-ethylenically unsaturated carboxylic acid such as ammonium acrylate.

10 Claims, No Drawings

PROCESS FOR SIZING TEXTILE FIBERS FOR USE ON WATER JET LOOMS

BACKGROUND OF THE INVENTION

This invention relates to the sizing of textile fibers for use in weaving with water jet looms and, more particularly, to the use of ammonium salts of certain carboxylic acid copolymers as warp sizes for such textile fibers.

A warp size is a chemical applied to a yarn comprising a warp for the purposes of protecting the yarn during subsequent handling and weaving. In these operations the yarns running in the warp direction are subjected to considerable abrasion from guide surfaces of split rods, drop wires, heddles, reed, shuttle and adjacent yarns. On a staple fiber yarn such as cotton, the size coats the yarn, protects it against abrasion and covers up such warp defects as knots, crossed ends, slubs and weak spots which occur in the normal variation of textile production. This is accomplished because the size glues down the protruding fibers, and provides an abrasion resistant coating for the fibers. On a filament yarn, the size coats the yarn and cements the filaments together to form essentially a monofilament yarn, thereby preventing chafing between filaments and between the yarn and guide surfaces.

Sizes such as corn starch, gelatin, carboxy methyl celluloses, polyvinyl alcohol, polyacrylic acid and styrene/maleic anhydride copolymers and alkali metal salts of ethylene/acrylic acid copolymers are conventionally employed as warp sizes for weaving on conventional fly shuttle looms as well as the more modern shuttleless rapier and projectile looms. However, due to the sensitivity of the conventional sizes to moisture, the weaver must carefully control weave room humidity to optimum levels for the size being used. This water sensitivity of conventional sizes renders such sizes totally unacceptable as sizes for warps to be woven on modern water jet looms.

In a water jet loom, a high pressure jet of water is used to carry the weft yarn through the loom shed, thereby forming the pick. During this operation, the warp yarn becomes saturated with water. If the warp yarn has been sized with conventional, water sensitive sizings, the size soon becomes water swollen and gummy causing yarn-to-yarn entanglement and size buildup at the heddle eyes and reed. Under such conditions, spun warp yarns break and filament yarns entangle, either of which necessitate stopping the loom. In view of the difficulties resulting from the use of conventional sizes on the water jet loom, weavers wishing to utilize the water jet loom must either use a relatively high twist unsized filament yarn or a low twist filament yarn sized with a water-insensitive composition. Use of a high twist yarn is feasible only in the manufacture of a few types of cloth, thus limiting the versatility of the water jet loom. Unfortunately, the water -insensitive sizes now being employed in the manufacture of fabrics employing low twist filament yarns are not totally water-insensitive and do not adhere well to the yarn.

In view of these difficulties existing in the weaving of textile fibers by water jet looms, it would be highly desirable to provide an improved process for sizing textile fibers for use in weaving with water jet looms and subsequently to desize the woven material.

SUMMARY OF THE INVENTION

The present invention is an improved process for sizing textile fibers to be employed in weaving with water jet looms. The improvement comprises the use of a water dispersible copolymer of an aliphatic $\alpha$-olefin and an ammoniated $\alpha$, $\beta$-ethylenically unsaturated carboxylic acid as a size for the textile fiber.

Surprisingly, the copolymer size employed in the present invention exhibits true hydrophobicity upon drying and good adhesion to natural and synthetic fibers; yet, the copolymer is readily removed from the textile fiber in conventional textile scouring and desizing operations. As a result of the copolymer possessing the foregoing characteristics, it is found that yarn sized with the copolymer can be allowed to stand in water for substantial periods of time without absorbing water or otherwise losing characteristics desirable of a sized textile fiber.

The process of the present invention most advantageously comprises a sizing step wherein the afore-mentioned copolymer is applied to the desired textile fiber and dried to a water-insensitive state. The sized textile fiber is then woven into fabric on a water jet loom. Optionally the sized fabric is then desized by subjecting the fabric to controlled conditions of aqueous base.

The present invention has particular application in the manufacture of woven fabrics of synthetic fibers, e.g., polyamides, polyesters, and polyacrylics; natural fibers, e.g., cotton, wool and blends thereof; cellulosic derivative fibers, e.g., acetates, triacetates and rayon; and blends of two or more of the aforementioned fibers.

DETAILED DESCRIPTION OF THE EMBODIMENTS

Generally, the copolymer size described in the present invention is employed to size longitudinal or warp yarns inasmuch as the traverse yarns (woof or weft yarns) are not ordinarily sized since they are subjected to little or no abrasive action from the loom. However, if desired, both weft and warp yarns can be treated using the copolymer size.

Both natural fibers such as cotton, wool, linen and silk fibers as well as fibers of synthetic materials such as polyamides such a nylon, polyacrylonitrile, polyvinylchloride, acrylonitrile/vinyl chloride copolymer, polyesters such as polyethylene terephthalate, cellulosics such as the acetates, triacetates and rayon, and like fibers can be sized by the copolymer size described herein. The copolymer size is effective on both filament and staple yarns.

The copolymer size suitably employed in the practice of this invention is a copolymer of an aliphatic $\alpha$-olefin and an ammoniated $\alpha$, $\beta$-ethylenically unsaturated carboxylic acid, i.e., $\alpha$, $\beta$-ethylenically unsaturated carboxylic acid in the ammonium salt form. By "aliphatic $\alpha$-olefin" is meant any aliphatic olefinic hydrocarbon containing a terminal double bond capable of polymerization under normal conditions of addition polymerization to form a water-insoluble homopolymer having a polyethylenic backbone. By "$\alpha$, $\beta$-ethylenically unsaturated carboxylic acid" is meant such an acid which is capable of addition copolymerization through the ethylenically unsaturated group with the hydrophobic monomer. Generally, such copolymers are water-dispersible, semi-solid or solid materials. Such copolymers have molecular weights which give melt flow viscosities in the range from about 0.5 to about 1000 decigrams per minute as measured using the procedure of ASTM D-1238-65T(D). Preferably, the copolymer has a melt flow viscosity in the range from about 100 to about 400 decigrams per minute as determined by ASTM D-123-65T(D). Preferred copolymers are also film-forming at temperatures used in the sizing operation. By "inherently water-dispersible" is meant a material which can exist in the form of a stable aqueous colloidal dispersion in the absence of a surface active agent. Also this characteristic inherent water dispersibility enables the copolymer to be removed from the textile fiber when the fiber is subjected to a conventional desizing operation such as passing the sized fiber through dilute aqueous sodium hydroxide. In addition, the copolymers in the form of aqueous dispersions form films under ambient conditions which films dry to form tough, adhesive water-insensitive coatings. By "a tough, adhesive, water-insensitive coating" is meant a coating of the copolymer which, when applied to a substrate and converted from ammonium salt form to acid form, will remain intact and adhere to the substrate while being subjected to wet abrasive conditions characteristic of weaving on a water jet loom.

Preferably, the copolymer size is a normally solid, water-insoluble thermoplastic copolymer in the form of a fluid aqueous colloidal dispersion. The occurrence of ammoniated acid groups in the polymer should be general throughout the macromolecules thereof so that each macromolecule contains a minimum concentration of active salt groups sufficient to render the copolymer inherently water-dispersible as defined hereinbefore. The maximum concentration of ammoniated acid groups which may be present in the macromolecules is fixed by the requirement that the copolymer, when converted to acid form as occurs upon drying the sized textile fiber, be substantially water-insensitive. Generally speaking such copolymers contain from about 10 to about 45 percent of ammoniated acid comonomer. Preferred copolymers contain from about 2 to about 30 weight percent of ammoniated acid comonomer, with especially preferred copolymers containing from about 15 to about 20 weight percent.

Exemplary preferred copolymers are the random copolymer products of copolymerization of mixtures of one or more ethylenically unsaturated carboxylic acids having three to eight carbon atoms inclusive of anhydride and alkyl half-esters of ethylenically unsaturated acid such as acrylic acid, methacrylic acid, maleic acid and anhydride, itaconic acid, fumaric acid, crotonic acid and citraconic acid and anhydride, methyl hydrogen maleate, ethyl hydrogen maleate, and one or more $\alpha$, $\beta$-ethylenically unsaturated aliphatic hydrocarbon monomers such as the aliphatic $\alpha$-olefin monomers, e.g., ethylene, propylene, butene-1 and isobutene. In addition, other $\alpha$, $\beta$-ethylenically unsaturated hydrophobic monomers are copolymerized with the aforementioned aliphatic $\alpha$-olefin and acid comonomers. Examples of such suitable monomers which need not be entirely hydrocarbon include conjugated dienes, e.g., butadiene and isoprene; monovinylidene aromatic carbocyclic monomers, e.g., styrene, $\alpha$-methylstyrene, ar-methylstyrene and ar(t-butyl) styrene; alkyl esters of $\alpha$, $\beta$-ethylenically unsaturated carboxylic acids such as ethyl acrylate, methyl methacrylate, ethyl methacrylate, methyl acrylate, isobutyl acrylate and the like; unsaturated esters of nonpolymerizable acid such as vinyl acetate, vinyl propionate and vinyl benzoate; vinyl halides such as vinyl and vinylidene chlorides; vinyl ethers; $\alpha$, $\beta$-ethylenically unsaturated nitriles such as acrylonitrile, methacrylonitrile and fumaronitrile. It is understood that the aforementioned suitable hydrophobic termonomers may be copolymerized with the aliphatic $\alpha$-olefin and the acid comonomer in proportions such that a water-insoluble copolymer is provided, preferably in proportions less than about 20 weight percent based on the copolymer. Especially preferred copolymers include copolymers from about 80 to about 85 weight percent of ethylene and from about 15 to 20 weight percent of one or more ammoniated ethylenically unsaturated acids, most preferably acrylic acid and/or methacrylic acid. Optionally in preferred polymers, there may be present from about 5 to 15 weight percent of an alkyl acrylate such as ethyl acrylate, n-butyl acrylate or isobutyl acrylate.

Alternatively, suitable copolymers may be made from preformed, nonacid polymers by subsequent chemical reactions carried out thereon. For example the carboxylic acid group may be supplied by grafting a monomer such as acrylic acid or maleic acid onto the polymer substrate such as polyethylene. Additionally, copolymers containing carboxylic anhydride, ester, amide, acyl halide and nitrile groups can be hydrolyzed to carboxylic acid groups which can then be neutralized to form the ammoniated acid carboxylic acid.

Specific procedures and means for making the polymers are known to the art as exemplified by U.S. Pat. Nos. 3,520,861 to Thompson et al. and 3,426,363 to Helin. Preferred low molecular weight copolymers are prepared according to the methods disclosed in the foregoing references except that a telogen such as propylene is employed in the reaction mixture. In instances wherein the acid copolymer is obtained in mass form, the copolymer may be converted to aqueous colloidal dispersion in accordance with the method of U.S. Pat. Nos. 3,799,901 to McCann et al.

The novel process for sizing and desizing of textile fibers briefly described hereinbefore comprises the steps of (1) contacting the textile fibers with an aqueous sizing dispersion of the above-identified inherently water -dispersible ammoniated copolymer having a concentration sufficient to deposit a sizing amount of the copolymer on the fibers; (2) weaving said textile fibers on a water jet loom into a fabric; and (3) desizing the textile fibers in said fabric by contacting the fabric with hot aqueous base, preferably aqueous alkali.

The term "sizing amount" as used herein is defined as a sufficient concentration by weight of dry size, based on the weight of the yarn, to effectively size the yarn. Those skilled in the textile art can readily determine the quantity of size which is satisfactory for the specific textile yarn to be sized. In most warp sizing of yarns, a sizing amount usually varies from about 1 to about 20 preferably from about 2 to about 8, weight percent of the copolymer based on the yarn weight. So long as the sizing amount of the copolymer size can be deposited, the concentration of the copolymer in the aqueous dispersion is not critical and the preferred concentration can be determined for each particular textile to be treated. However, as a general rule for most sizing applications, the aqueous colloidal dispersion of the copolymer employed as the size bath has a polymer solids content from about 2 to about 40 weight percent based on the total weight of the dispersion and sufficient stabilizing ammonia to give dispersion of pH of at least about 6, preferably at least about 8.5 up to about 11. The high solids dispersions, e.g., greater than 25 weight percent, are suitably prepared from lower solid dispersions by the method disclosed in U.S. Pat. No. 3,644,258 to Moore et al.

In addition to the aforementioned copolymer sizing agent, other additives conventionally employed in the treatment of fibers prior to weaving are suitably employed so long as they do not appreciably increase the water-sensitivity of the copolymer sizing agent or significantly weaken it. Of particular interest are the additives that increase the adhesion of the copolymer sizing agent to certain textile fibers. For example, the melamine -formaldehyde resins which have a degree of alkylation less than 90 mole percent, preferably less than 75 mole percent, significantly improve the adhesion of the copolymer to polyester fibers. Such melamine-formaldehyde resins are more fully described in U.S. Pat. Nos. 3,440,184. When employed, such adhesion promoters are generally added in amounts ranging from about 2 to about 20 weight percent, preferably from about 2.5 to about 10 weight percent, based on the weight of the ammoniated copolymer.

Except as described hereinbefore, the sizing step is generally carried out in a conventional manner. For example, drying the sized yarn at temperatures in the range from about 280 ° to about 400° F is generally sufficient to provide a sized yarn having the desired degree of water resistance. Preferably, however, the sized textile fiber is dried at a temperature of about 100° to about 200° C for a period of from about 1 to 10 minutes.

The present invention is most advantageously practiced when the weaving step is carried out on a water jet loom. For the purposes of this invention, weaving on a water jet loom is generically described as that fabric formation process wherein the weft yarn is propelled across the width of the fabric by means of a high pressure jet of water (instead of a shuttle, gripper or a rigid or flexible rapier weft insertion means as in conventional weaving). Otherwise, the weaving process is essentially the same as for conventional weaving. Water jet looms of the types advantageously employed in the practice of this invention are described in greater detail in U.S. Pat. Nos. 3,180,368, 3,372,711 and 3,233,634.

When desired, a copolymer size is readily removed from the woven fabric by subjecting the fabric to conditions comparable to the digestion conditions described in U.S. Pat. No. 3,799,901. In an especially preferred desizing step, the fabric is immersed in a 0.05 to 0.25 molar aqueous solution of sodium hydroxide at 175° to 212° F for a period of 15 to 60 minutes.

The following examples are given to illustrate the preferred embodiments of the invention and should not be construed as limiting its scope. In these examples all parts and percentages are by weight unless otherwise indicated.

EXAMPLE 1

A 1,000 gram portion of an ethylene/acrylic acid (85%/15%) copolymer having a melt flow viscosity of 300 decigrams per minute as determined by ASTM D-1238-65T Condition (D) is added to a vessel containing 287 grams of 28% ammonium hydroxide and 3479grams of water. The foregoing ingredients are stirred at 95° C until the copolymer dissolves to yield a homogeneous cloudy dispersion having a pH of 10.5, a solid content of 21% and a Brookfield RVT viscosity of 50 cps at 50 rpm and 20° C using a No. 2 spindle. The aqueous dispersion is cooled to room temperature and diluted with water to a solids content of 10.5%. This dispersion is employed as a size solution by placing it in a size box of a Calloway Laboratory Slasher. A warp sheet of 50/1 polyester/cotton (65%/35%) yarn is sized using the following conditions:

| | |
|---|---|
| QUETSCH pressure: 20 lbs/linear inch | |
| SLEY: 60 ends/inch | |
| wet size add-on: 80% | |
| slasher speed: 40 yds/min. | |
| dryer can temperature: | (1) 275° F; (2) 275° F; (3) 250° F (4) 250° F. |

A two-yard sample of sized yarn is dried at 100° C for ½ hour, weighed and desized in a miniature washing machine in a 2% aqueous solution of sodium hydroxide containing 0.5% of octophenoxypolyethoxyethanol at 175° F. The desizing bath containing the yarn is agitated at 100 rpm for 15 minutes. The yarn is removed, rinsed twice in clear water and dried to a constant weight at 100° C. The size add-on was found to be 8.5 percent using the equation:

$$\frac{(\text{wt. of sized yarn}) - (\text{wt. of desized yarn})}{(\text{wt. of desized yarn})} \times 100 = \%\ \text{size add-on.}$$

All of the size is judged to be removed by comparison of the desized yarn with scoured yarn that has never been sized.

Another sample of the sized yarn is then tested on an entanglement tester (a device that simulates the loom shedding motion). Forty ends of yarn are drawn into a two harnessed heddle at a sley of 90 and reeded at 2 ends/dent. Through a motor driven eccentric cam, the harnesses can be made to shed at a rate equivalent to 180 picks/min. The shed opening is 4.5 inches and there is no provision made for tension let-off. The entanglement tester is started and the wrap yarns are sprayed with atomized deionized water until dripping wet. The tester is run 30 minutes. No yarns break and the degree of yarn-to-yarn entanglement is very low as compared to similar testing of yarns sized with conventional sizing agents. The foregoing tests indicate good sizing performance of the copolymer size under simulated water jet loom operating conditions.

EXAMPLE 2

A. Water-Insensitivity

In order to demonstrate the superior water resistance of the copolymer sizes of the present invention over the alkali metal salts of similar copolymers, e.g., the type described in U.S. Pat. No. 3,472,825, several aqueous dispersions are prepared of the copolymer containing different proportions of ammonium and sodium ions as indicated in Table I. Each dispersion is applied in the form of a 3 mil (wet) thick layer at 21 percent solids to a nylon 6 film and dried for four minutes at 100° C. A 2 × 12 inches strip is cut and labelled as to the composition applied and is placed into a 32-ounce bottle containing about 16 ounces of tap water. The bottle is then placed on a shaker table running at 200 full cycles per minute. After 30 minutes the film strips are removed from the bottles and examined. The results are recorded in Table I.

TABLE I

| Sample No. | %$NH_4$/%Na[1] | Water Sensitivity |
|---|---|---|
| 1 | 100%/0% | Clear, adherent film after 1½ hours |
| 2* | 50%/50% | Complete delamination after 30 minutes |
| 3* | 0%/100% | Complete delamination after 30 minutes |
| 4* | 80%/20% | Complete delamination after 1½ hours |
| 5* | 90%/10% | Complete delamination after 1½ hours |

*Not an example of the invention
[1]Percentages refer to degree of neutralization of total acrylic acid moiety by the specified cation.

As evidenced by the foregoing data, the copolymer size of the present invention, which exhibits adhesive strength greater than the tensile strength of the copolymer film after 1½ hours in water, has a water resistance for superior to same copolymer neutralized with even small amounts of alkali metal. This degree of water resistance (hydrophobicity) is necessary to prevent size build-up on the reeds and heddles of water jet loom.

B. Wet and Dry Adhesion

In order to minimize loom shut-down time resulting from the accumulation of size on critical parts of the water jet loom, e.g., heddles and heddle eyes as well as the reed dents, it is necessary that the copolymer sizing agent exhibit good dry and wet adhesion to the textile fibers. Accordingly, the copolymer size of Example 1 is tested for wet and dry adhesion to nylon and the results of these tests are reported in Table II.

For purposes of comparison, the sodium salt of the aforementioned ethylene/acrylic acid copolymer and several conventional sizes are similarly tested.

Table II

| Sample No. | Size | Adhesion Dry[1] | Adhesion Wet[2] |
|---|---|---|---|
| 1 | E/AA-$NH_4$[a] | Pass | Pass-clear |
| $C_1$* | E/AA-Na[b] | fail | delaminates-clear |
| $C_2$* | VA/AA[c] | fail | delaminates-hazy |
| $C_3$* | BA/EA/AA[d] | fail | disintegrates-hazy |

Table II-continued

| Sample No. | Size | Adhesion Dry[1] | Adhesion Wet[2] |
|---|---|---|---|
| $C_4$* | DEG/EG[e] | fail | size dissolves |

*Not an example of the invention
[a]ammonium salt form of ethylene/acrylic acid copolymer of Example 1
[b]sodium salt form of ethylene/acrylic acid copolymer of Example 1
[c]partially hydrolyzed vinyl acetate/acrylic acid copolymer
[d]butyl acrylate/ethyl acrylate/acrylic acid copolymer
[e]diethylene glycol-ethylene glycol 5-sodiosulfoisophthalic acid, isophthalic acid, adipic acid (8 moles/2 moles/1 mole/8 moles/1 mole)
[1]A 3-mil wet film of the size is cast with a drawdown bar on nylon film (Capran Nylon 6) and is dried at 350° F for 3 minutes. A 3-inch strip of Scotch No. 610 tape is pressed against and adhered to the coated side of the nylon film. The tape is then pulled abruptly from the coated nylon film. The size passes if it remains on the nylon film after the tape is pulled away.
[2]The coated nylon films (2" × 3" strips) prepared in the preceding test are placed in an 8-oz. bottle containing 4 oz. of water and the bottle is shaken at 200 cycles/-min. with the direction of agitation being parallel to the long axis of the bottle. After 2 hours, the films are observed for continuity, clarity and adhesion.

C. Severe Adhesion and Wet Abrasion

Sizing compositions containing the size at approximately 20% solids are cast as continuous films on a nylon film using a casting rod designed to cast a wet film having a thickness of 6 mils. The coated films are dried in a circulating hot air oven at 100° C for 4 minutes, removed and allowed to cool.

The films are tested for severe dry adhesion and wet abrasion and the results are recorded in Table III.

Table III

| Sample No. | Size | Severe Adhesion[3] | Wet Abrasion[4] No. of double strokes to failure/ coating condition |
|---|---|---|---|
| 1 | E/AA-$NH_4$[a] | Pass | No failure after 300/clear |
| $C_1$* | 93.5% E/AA-$NH_4$[a] 6.5% E/AA-Na[b] | Pass | 5/clear |
| $C_2$* | 87% E/AA-$NH_4$[a] 13% E/AA-Na[b] | Fail | 5/clear |
| $C_3$* | 65% E/AA-Na[b] 35% E/AA-$NH_4$[a] | Fail | Film delaminates |
| $C_4$* | VA/AA[c] | Fail | 52/slight haze |
| $C_5$* | BA/EA/AA[d] | Fail | Film disintegrates |
| $C_6$* | DEG/EG[e] | Fail | 10/hazy, gummy |

*Not an example of the invention
[a] – [e]same as in Table II
[3]A portion of the film is crosshatched by cutting the coating in a X-configuration using a razor blade. The remainder of the test is carried out as in [1] of Table II.
[4]A remaining portion of the coated film is shaken in water as in [2] of Table II. The wet film is withdrawn from the bottle and examined. If the coating is intact and adheres to the nylon film, the wet coating is rubbed up to 300 double strokes (reciprocating back and forth motion over a ½" distance) with the ball end of an 18 oz. ball peen hammer which has been wrapped with four layers of water moistened cheesecloth. Failure occurs if the coating is abraded away to reveal the film in less than 80 double strokes.

D. Polyester

Following the foregoing procedure except substituting a polyethylene terephthalate film for the nylon film, several coated film samples are prepared and tested for severe adhesion and wet abrasion. The results of the tests are recorded in Table IV.

Table IV

| Sample No. | Size | Severe Adhesion[3] | Wet Abrasion[4] No. of double strokes to failure/coating condition |
|---|---|---|---|
| 1 | E/AA-$NH_4$[a] | Fail | 250/clear |
| 2 | 95% E/AA-$NH_4$[a] 5% MM83[f] | Pass | >300/clear |
| $C_1$* | 93.5% E/AA-$NH_4$[a] 6.5% E/AA-Na[b] | Fail | 5/clear |
| $C_2$* | 87% E/AA-$NH_4$[a] 13% E/AA-Na[b] | Fail | 3/clear |
| $C_3$* | E/AA-Na[b] | Fail | 1/hazy |
| $C_4$* | VA/AA[c] | Fail | 79/slightly hazy |
| $C_5$* | BA/EA/AA[d] | Fail | 5/opaque |

Table IV-continued

| Sample No. | Size | Severe Adhesion[3] | Wet Abrasion[4] No. of double strokes to failure/coating condition |
|---|---|---|---|
| $C_6$* | DEG/EG[e] | Fail | 3/gummy |

*not an example of the invention
[a] – [e]same as in Table III
[f]Melamine-formaldehyde resin having a degree of alkylation of ~10 mole percent and sold under the trademark MM83 of Rohm and Haas
[3] – [4]same as in Table III.

E. Water Jet Loom Weaving

A sizing formulation is prepared by diluting a 21% solids aqueous dispersion of the ammonium salt form of an ethylene/acrylic acid (85/15) copolymer having a melt flow viscosity of 300 [ASTM D-1238-65T(D)] with cold water to a solids content of 6.7%. A warp having a length of 2500 yards and consisting of 4788 ends of 70 denier 34 filament untwisted flat polyamide yarn is sized with the foregoing formulation using a slasher having an electric hot air predrying section. The conditions employed in the sizing step are as follows:

| Size Temp. | Quetsch Pressure | Split Type | Predryer Temp. | Slasher Speed | Size Add-On |
|---|---|---|---|---|---|
| 65° F | 25 psi | wet | 300° F | 60 ypm | 2.2%* |

*corrected for oil on the yarn.

The sized warp is then woven on a Nissan LW 41 water jet loom in a plain weave pattern to produce a taffeta fabric of 96 × 86 count. The loom data observed is as follows:

| Construction | | | Loom | Stops/10,000 picks | | | Size Buildup | |
|---|---|---|---|---|---|---|---|---|
| Count | Ends | Width | Speed | Warp Related | Weft Related | Other | Reed | Heddles |
| 96 × 86 | 4788 | 49¼ in. | 440 rpm | 0.032 | 0.056 | 0.021 | None | None |

F. Desizing and Dyeing

A 100-yard length of the resulting fabric is doffed and desized by placing the fabric in a jig containing water at 173° F and 5 g./l. of NaOH and 1 g./l. of nonionic surfactant (ethylene oxide condensate). A total weight loss of 1.36% is observed. After correction for oil content of the yarn, a size add-on of 2.3 percent based on the weight of the warp is calculated.

A 10-g. sample of the desized fabric is dyed using Acid Violet 12 (C.I. 18075) at 1% owf using conditions conventional for acid dyeing of polyamide fabric. Upon exhaustion of the dye bath, the fabric is removed, rinsed and dried. Inspection of the dyed fabric indicates no spotting, streaking or other flaw attributable to incomplete size removal.

What is claimed is:

1. In a process for weaving textile fibers into fabric on a water jet loom wherein the fibers are sized prior to weaving, the improvement which comprises (a) depositing on the fibers a sizing amount of an inherently water dispersible copolymer of an aliphatic $\alpha$-olefin and an ammoniated $\alpha$, $\beta$-ethylenically unsaturated carboxylic acid, (b) drying the resulting textile fibers such that the copolymer forms a tough, adherent water-insensitive coating on the textile fibers, and (c) weaving the resulting sized fibers on a water jet loom.

2. The improvement of claim 1 wherein the $\alpha$-olefin is ethylene or propylene and the acid is acrylic acid or methacrylic acid.

3. The improvement of claim 1 wherein the copolymer is a fully ammoniated ethylene/acrylic acid binary copolymer.

4. The improvement of claim 3 wherein the copolymer contains from about 12 to about 30 weight percent of acrylic acid in ammonium salt form and has a 30 flow viscosity as determined by ASTM D-1238-65T(D) in the range from about 100 to about 400 decigrams/minute.

5. The improvement of claim 4 wherein the textile fibers are polyamide.

6. The improvement of claim 4 wherein the textile fibers are polyester and an adhesion promoting amount of a melamine-formaldehyde resin is employed in combination with the copolymer.

7. The improvement of claim 6 wherein the amount of melamine-formaldehyde resin is in the range from about 2.5 to about 10 weight percent based on copolymer weight and the resin has a degree of alkylation less than 75 mole percent.

8. The improvement of claim 4 wherein the sizing amount of copolymer is in the range from about 2 to about 8 weight percent based on the weight of the textile fibers.

9. The improvement of claim 8 wherein the textile fibers are nylon.

10. The improvement of claim 1 comprising the additional step of desizing the fabric by contacting it in aqueous base until the copolymer is removed from the textile fibers of the fabric.

* * * * *

UNITED STATES PATENT OFFICE

CERTIFICATE OF CORRECTION

Patent No. 4,015,317 Dated April 5, 1977

Inventor(s) Kenneth E. Johnsen

It is certified that error appears in the above-identified patent and that said Letters Patent are hereby corrected as shown below:

On the title page, under "[56] References Cited", the second referenced inventor's name should read --Ravve et al.--;

Column 2, line 46, "a" should read --as--;

Column 3, line 5, "ASTM D-123-" should read -- ASTM D-1238- --;

Column 3, line 40, "2" should read --12--;

Column 3, line 67, "acid" should read --acids--;

Column 4, line 38, "Nos." should read --No.--;

Column 5, line 18, "Nos." should read --No.--;

Column 5, line 26, "280°" should read --250°--;

Column 6, line 2, "3479" should read --3470--;

Column 6, line 46, "wrap" should read --warp--;

UNITED STATES PATENT OFFICE

CERTIFICATE OF CORRECTION

Patent No. 4,015,317 Dated April 5, 1977

Inventor(s) Kenneth E. Johnsen

It is certified that error appears in the above-identified patent and that said Letters Patent are hereby corrected as shown below:

Column 6, line 66, "inches" should read --inch--;

Column 7, line 24, "for" should read --far--;

Column 10, line 23, "30" should read --melt--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*